US006877979B2

(12) United States Patent
Abbasi et al.

(10) Patent No.: US 6,877,979 B2
(45) Date of Patent: Apr. 12, 2005

(54) PROCESS AND APPARATUS FOR INDIRECT-FIRED HEATING AND DRYING

(75) Inventors: Hamid Ali Abbasi, Naperville, IL (US); Yaroslav Chudnovsky, Skokie, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 10/454,021

(22) Filed: Jun. 4, 2003

(65) Prior Publication Data

US 2004/0096795 A1 May 20, 2004

Related U.S. Application Data

(60) Provisional application No. 60/426,484, filed on Nov. 14, 2002.

(51) Int. Cl.[7] ..... F23C 5/00

(52) U.S. Cl. ..... 431/8; 431/11; 34/108; 34/110

(58) Field of Search ..... 431/8, 11, 12; 34/108, 110, 113, 114, 124, 134; 165/89

(56) References Cited

U.S. PATENT DOCUMENTS 3,452,967 A * 7/1969 Durand ..... 432/228
4,562,655 A * 1/1986 Bosshart et al. ..... 38/52
4,677,773 A * 7/1987 Kamberg ..... 38/44
4,688,335 A * 8/1987 Krill et al. ..... 34/273
4,693,015 A * 9/1987 Hemsath et al. ..... 34/454
5,416,979 A 5/1995 Joiner
5,553,391 A * 9/1996 Bakalar ..... 34/110
5,791,065 A 8/1998 Gamble et al.
5,842,285 A 12/1998 van der Veen
5,966,835 A * 10/1999 Bakalar ..... 34/267
6,560,893 B1 * 5/2003 Bakalar ..... 34/110

FOREIGN PATENT DOCUMENTS

WO WO 99/45196 10/1999

* cited by examiner

*Primary Examiner*—Alfred Basichas
(74) *Attorney, Agent, or Firm*—Mark E. Fejer

(57) ABSTRACT

A method for heating flat or curved surfaces comprising injecting fuel and oxidant along the length, width or longitudinal side of a combustion space formed between two flat or curved plates, transferring heat from the combustion products via convection and radiation to the surface being heated on to the material being dried/heated, and recirculating at least 20% of the combustion products to the root of the flame.

22 Claims, 4 Drawing Sheets

PROCESS AND APPARATUS FOR INDIRECT-FIRED HEATING AND DRYING

CROSS REFERENCE TO RELATED APPLICATION

This application claims the benefit of an earlier filed provisional application having Ser. No. 60/426,484 and a Filing Date of 14 Nov. 2002.

This invention was made with Government support under DOE Contract No. DE-FC36-01GO10621 awarded by the Department of Energy. The Government has certain rights in this invention.

BACKGROUND OF THE INVENTION

1. Field of the Invention

This invention relates to a method and apparatus for heating flat or curved surfaces such as those found in paper, textile and food drying equipment. More particularly, this invention relates to a method and apparatus for heating flat or curved surfaces employing indirect firing means to increase the temperature uniformity and heat flux of equipment employing such surfaces, to reduce $NO_x$ emissions formation utilizing flue gas recirculation, and to increase the overall system thermal efficiency.

2. Description of Related Art

A significant amount of heating/drying, such as paper and textile drying, is carried out in indirectly fired equipment that is heated by steam. This approach limits the maximum heating surface temperatures because of the increasing steam pressure requirements at higher temperatures. As a result, equipment such as steam paper dryers are generally limited to temperatures below about 400° F. Several gas-fired heater/dryer concepts have been developed for providing higher heating surface temperatures, but implementations of these are generally complex in design.

One approach to addressing these issues has been the use of fuel combustion within a drum dryer to heat the surface of the drum, either through the use of radiant burners or open flame burners that direct combustion gases at the drum surface. U.S. Pat. No. 5,416,979 teaches a paper drying apparatus consisting of a rotatable dryer drum with a plurality of burners located in a hood partially surrounding the drum and means for directing hot combustion products towards the wet paper. U.S. Pat. No. 5,791,065 teaches a rotating drying cylinder with a gas-fired assembly employing segmented burners mounted in the interior of the cylinder to transmit heat to the cylinder by convection and infrared radiation. U.S. Pat. No. 5,842,285 teaches a drying apparatus having a number of independently controllable radiant gas burners located inside the drum to heat the drum. PCT International Publication WO 99/45196 teaches a rotating drying cylinder having a ribbon burner facing towards and adjacent to an inner surface of the cylinder and an acoustic baffle mounted behind the burner. In addition, a hollow roller heated by burning fuel internally and directing hot products of combustion against the inner surface of the roller and a baffle means disposed behind the burner for absorbing sound is also taught by this publication.

SUMMARY OF THE INVENTION

It is one object of this invention to provide a method and apparatus for heating flat or curved surfaces which provides for more uniform temperature control over conventional methods and apparatuses.

It is one object of this invention to provide a method and apparatus for heating flat and curved surfaces that provides reduced $NO_x$ emissions formation compared to conventional equipment and methods.

It is another object of this invention to provide a method and apparatus for heating flat and curved surfaces that provides increased convective heat transfer as well as greater thermal efficiency over conventional equipment and methods.

These and other objects are addressed by a method and apparatus in which a hydrocarbon fuel and oxidant at ambient temperature, or preheated to temperatures up to about 1500° F., are injected through one or more slots, holes, or porous matrices, premixed or separately, into and along a thin space, typically 0.5 to about 6 inches thick, referred to as the combustion space, formed between two flat or curved plate surfaces. The fuel and oxidant burn to form a substantially sheet-shaped flame within the combustion space. The kinetic energy in the flame induces substantial amounts of recirculation, greater than about 20%, preferably in the range of about 20% to about 200%, of cooled products of combustion into the root of the flame, thereby cooling the flame and reducing $NO_x$ formation. In addition, the recirculated gases increase the flow rates and velocities, thereby improving temperature uniformity of the heating surface and increasing the convective heat transfer rates. The method of this invention is applicable to a wide range of heaters and dryers, such as drum dryers, heating, curing, drying and baking ovens and cooking griddles.

DETAILED DESCRIPTION OF THE PRESENTLY PREFERRED EMBODIMENTS

Figure 1:
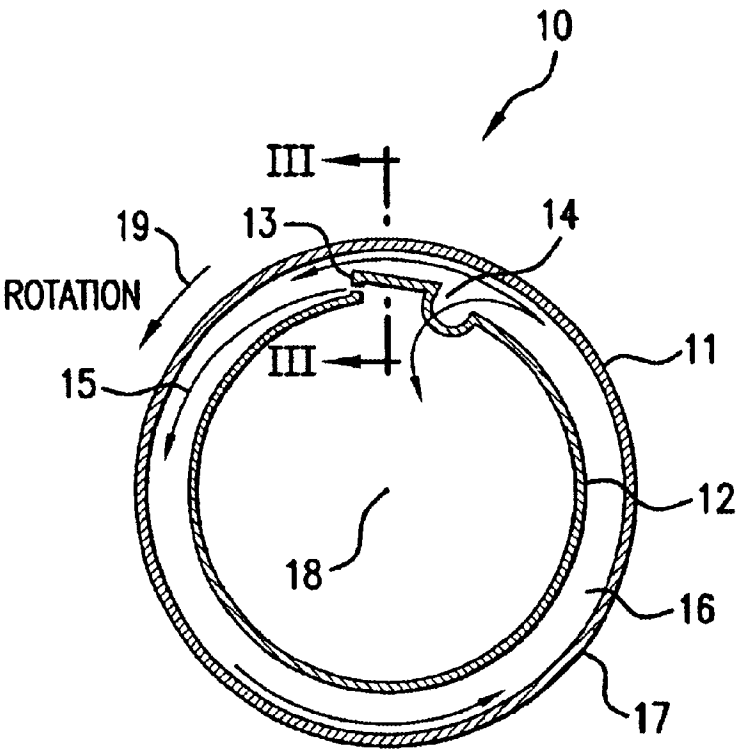
FIG. 1 shows a curved surface heater in accordance with one embodiment of this invention in which the material of interest is heated or dried on the outside of the curved surface.

As shown in accordance with one embodiment of this invention in FIG. 1, the apparatus of this invention is a rotary drum dryer 10, typical of heating equipment employed in applications such as paper and textile drying. The dryer 10 comprises two concentrically disposed cylindrically-shaped surfaces 11 and 12 which form an annular space 16 therebetween. In accordance with this embodiment, surface 11 is a heating/drying surface which comprises an outward facing face or heating side 17 which acts as a heating surface with which materials to be dried (not shown) are in contact. In accordance with one embodiment, cylindrically-shaped surface 11 is rotatable around its longitudinal axis, represented by point 18. Cylindrically-shaped surface 12 may be stationary or rotatable around its longitudinal axis and forms at least one fuel inlet and at least one air inlet, both designated by reference numeral 13. In accordance with one embodiment of this invention as shown in FIG. 3B, the fuel and oxidant are premixed and introduced into the annular space 16 through fuel/oxidant inlet 13, which is in the form of a single slot. In accordance with an alternative embodiment, the fuel and air are introduced through separate inlets 13*a* and 13*b* into the annular space 16 as shown in FIG. 3A.

Figure 2:
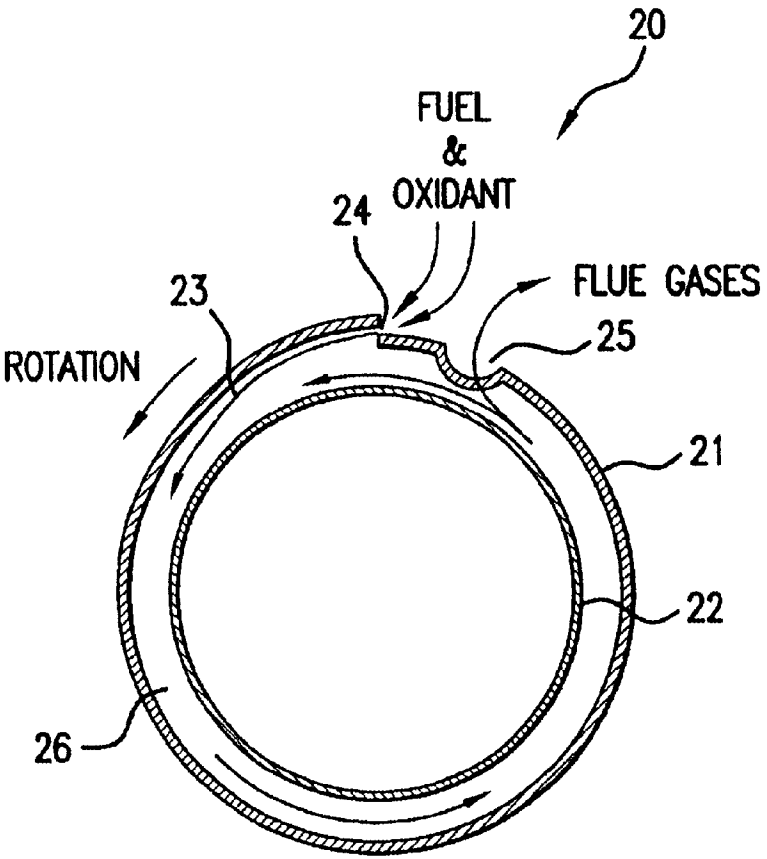
FIG. 2 shows a curved surface heater in which the material being dried is disposed on the inside of the curved surface.
Figure 3A:
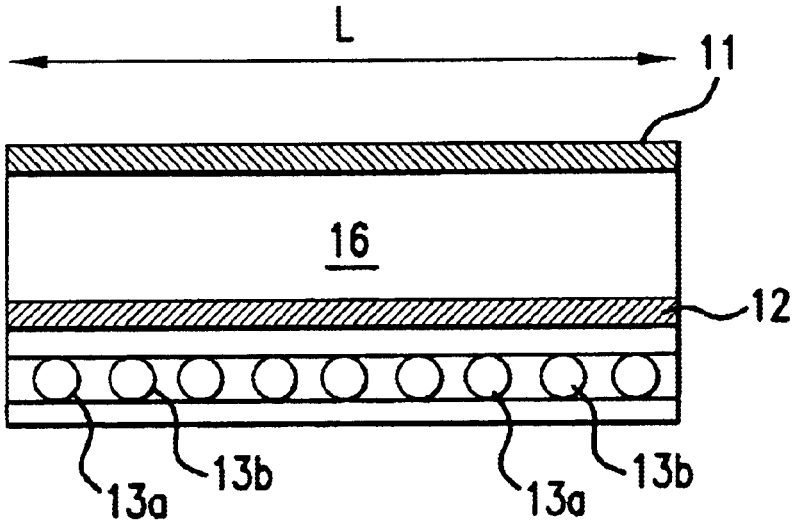
FIGS. 3A and 3B show a cross-sectional view of the curved surface heater of FIG. 1 taken along the line III—III.
Figure 3B:
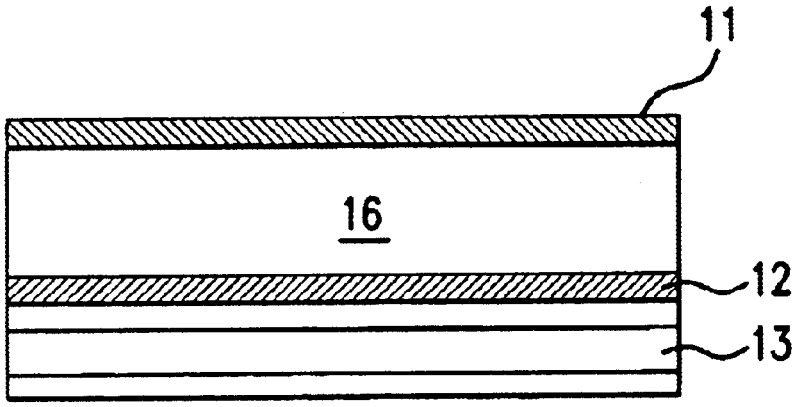

The flame resulting from the combustion of the fuel and oxidant is a substantially flat sheet flame, designated by arrow 15 in FIG. 1 and arrow 23 in FIG. 2, which substantially traverses the length L, as shown in FIG. 3A, of the cylindrical-shaped surfaces. In addition, as shown in FIGS. 3A and 3B, alignment of the fuel/oxidant inlet(s) is such that the fuel and oxidant are introduced into the annular space 16 in a direction generally corresponding to the direction of rotation of cylindrically-shaped surface 11 as indicated by arrow 19. Consequently, the resulting flame substantially conforms in shape to the curvature of the cylindrically-shaped surfaces 11, 12, thereby avoiding undesirable direct impingement of the flame against cylindrically-shaped surface 11, and minimizing the formation of hot spots, which can adversely impact the uniformity of the heating process, as well as the life of the heater/dryer.

In addition to fuel and oxidant inlets 13, cylindrically-shaped surface 12 forms a combustion products or flue gas outlet 14 through which the products of combustion may be exhausted from annular space 16. In accordance with one particularly preferred embodiment of this invention, at least a portion of the products of combustion are diverted from the flue gas outlet 14 and recirculated to the base portion or root of the flame. By "base portion" or "root" of the flame, we mean that portion of the flame proximate the initiation of combustion of the fuel and oxidant.

An alternative embodiment of the apparatus of this invention is shown in FIG. 2. The apparatus 20 comprises two concentrically disposed, cylindrically-shaped surfaces 21 and 22, which form annular space 26 therebetween. In contrast to the embodiment shown in FIG. 1, it is the inner cylindrically shaped surface 22 that is rotatable. Thus, in accordance with the embodiment of FIG. 2, cylindrically-shaped surface 21, that is the outer cylindrically-shaped surface, forms a fuel/oxidant inlet 24 through which fuel and oxidant are introduced into annular space 26 and a flue gas outlet 25 through which the products of combustion produced by the flame, designated as reference numeral 23, are exhausted from annular space 26.

Figure 4:
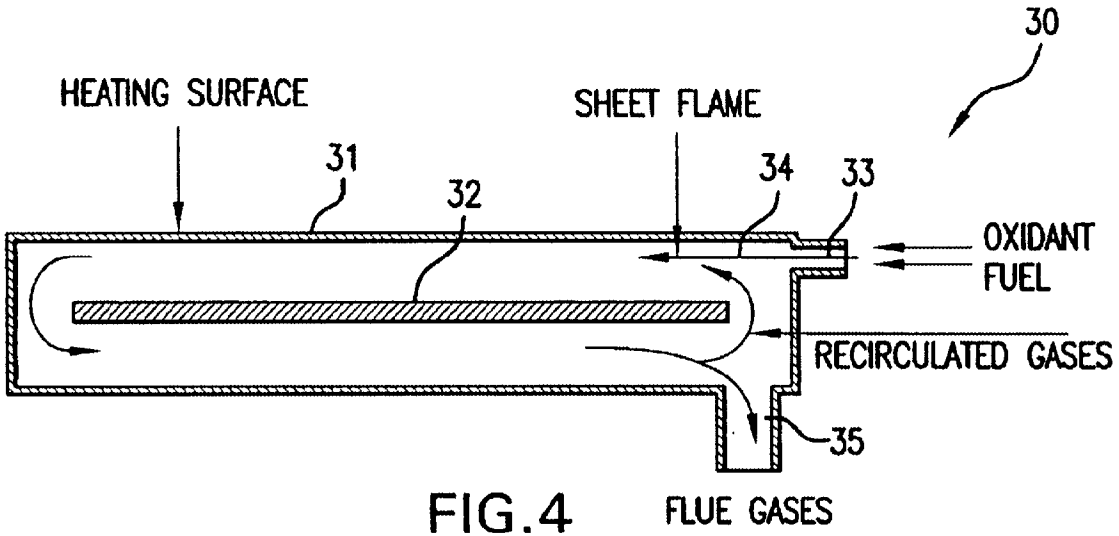
FIG. 4 shows an application of the method of this invention to a flat surface heater.

FIG. 4 shows one embodiment of the apparatus of this invention comprising correspondingly-shaped surfaces 31 and 32, which, in contrast to the curved surfaces of the embodiments of FIGS. 1 and 2, are flat. The apparatus 30 further comprises a fuel/oxidant inlet 33 for introduction of fuel and oxidant, which, upon ignition, produce a substantially linear sheet flame, designated by arrow 34. As shown, the products of combustion circulate around surface 32 and are exhausted through flue gas outlet 35. In accordance with one embodiment, at least a portion of the products of combustion are recirculated to the root of the flame 34.

In accordance with one embodiment of this invention, the combustion products exiting the combustion space are passed through a heat exchanger to preheat the combustion oxidant and/or fuel for heat recovery and efficiency improvement. In accordance with another embodiment, the heating surface plate moves in the same direction as the flame gases, for example as in drum/hollow roller dryers, whereby the amount of combustion gas recirculation is further increased, thereby further reducing $NO_x$ formation and increasing convective heat transfer rates.

Figure 5B:
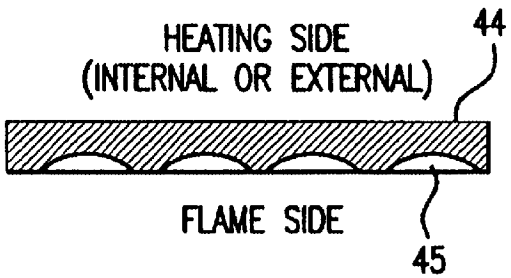
FIGS. 5*a* and 5*b* show an application of the method of this invention in which the heated plate surface incorporates heat-transfer enhancement features, e.g. dimples, on the flame side of the surface to further increase the heat transfer rates, resulting in higher heating/drying rates as well as further reduced $NO_x$ formation as a result of the recirculation of cooler gases.
Figure 5A:
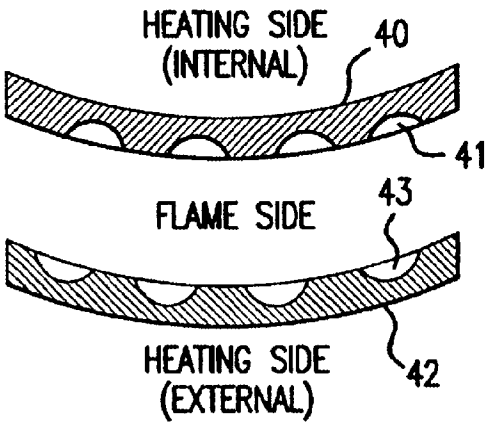

In accordance with one embodiment of this invention as shown in FIGS. 5A and 5B, the face of the heating/drying surface 40, 42, 44 opposite the heating side, that is the flame-facing side, comprises heat transfer means for enhancing the transfer of convective heat from the flame to the heating/drying surface. In accordance with one particularly preferred embodiment, the heat transfer means are in the form of depressions or dimples 41, 43, 45 formed by the heating/drying surface 40, 42, 44 on the flame facing side thereof.

In accordance with the method of this invention, a fuel and oxidant are injected along the length, width or longitudinal side of a combustion space formed between two correspondingly-shaped surfaces. In accordance with one embodiment of this invention, the correspondingly-shaped surfaces are concentrically disposed, cylindrically-shaped surfaces, one of which constitutes a heating surface for providing the heating/drying function of the apparatus and the other of which provides a means for introducing the fuel and oxidant into the combustion space. In accordance with another embodiment of this invention, the correspondingly-shaped surfaces are in the form of flat plates. Heat from the combustion products is transferred by convective and radiant heat transfer mechanisms to the surface being heated and on to the material being dried/heated. At least a portion of the combustion products are recirculated to the root of the flame. In accordance with one preferred embodiment of this invention, at least about 20% up to about 200% of the combustion products are recirculated back to the root of the flame.

As previously indicated, the fuel and oxidant may be injected into the combustion space through separate openings in one of the correspondingly-shaped surfaces. Alternatively, the fuel and oxidant may be premixed and the mixture introduced through the same opening(s). To provide the possibility of providing temperature profiling across the surfaces, the fuel and/or oxidant may be segmented into individually controlled sections.

To avoid direct impingement of the flame against the heating surface, the fuel and oxidant are injected into the combustion space at an angle less than about 45 degrees to the surfaces at the plane of injection. In accordance with a particularly preferred embodiment, the fuel and oxidant are injected substantially parallel to the surfaces.

In accordance with one embodiment of this invention, at least a portion of the products of combustion exiting the combustion space are passed through a heat exchanger for preheating the combustion oxidant and/or fuel. In accordance with one preferred embodiment of this invention, the stationary surface of the correspondingly-shaped surfaces is incorporated into the heat exchanger to preheat the incoming oxidant and/or fuel.

Figure 6:
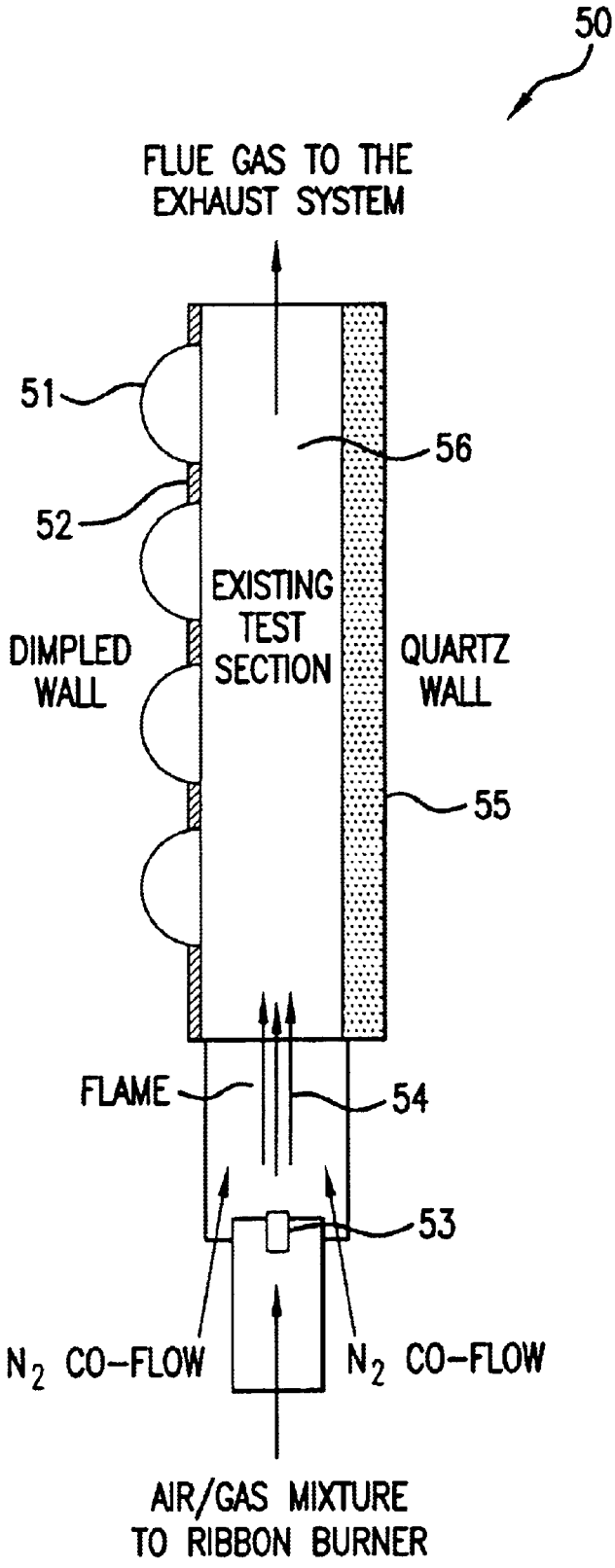
FIG. 6 shows the test section of an apparatus in accordance with one embodiment of this invention using a metal plate with dimple enhancements and a parallel quartz plate to allow observation of the flame.

To test the method of this invention, an apparatus as shown in FIG. 6 was constructed. The vertically oriented apparatus 50 comprises a combustion space 56 formed between a dimpled wall 52 comprising a plurality of dimples 51 and a quartz wall 55. The apparatus further comprises a commercial ribbon burner 53 for introduction of a fuel/air mixture disposed at the base of the apparatus, which mixture is ignited, resulting in formation of a thin sheet flame 54. Heated nitrogen was supplied to the bottom to simulate recirculation of the cooled products of combustion. Average data for this ribbon burner fired with 85 SCFH of natural gas and about 15% excess air are shown in the following table.

| Recirculation Flow % total POC flow | Nitrogen oxides vppm |
|---|---|
| 0 | 48 |
| 25 | 35 |
| 50 | 32 |
| 100 | 30 |

The temperature of the heated dimpled flat wall reached levels of 800-1000° F. without any heating/drying material. Rough temperature uniformity measured manually by contact thermocouple was about ±50° F. The above data show significant $NO_x$ reductions with recirculation without any attempts at system optimization.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. A method for heating flat or curved surfaces comprising:

injecting fuel and oxidant along one of a length, a width and a longitudinal side of a combustion space formed between two plates, said plates being one of flat and curved in shape;

burning said fuel and oxidant in said combustion space, forming a flame and combustion products;

transferring heat from said flame and combustion products by convection and radiation to a surface being heated on to a material being heated; and recirculating at least 20% of said combustion products directly to a root of said flame.

2. A method in accordance with claim 1, wherein the fuel and oxidant are injected through separate openings formed by one of said two plates.

3. A method in accordance with claim 1, wherein the fuel and oxidant are mixed prior to injection, forming a mixture, and said mixture is injected into said combustion space through at least one opening formed by one of said plates.

4. A method in accordance with claim 1, wherein the fuel and oxidant are injected substantially parallel to said plates.

5. A method in accordance with claim 1, wherein the fuel and oxidant are injected at an angle less than about 45 degrees to said plates at a plane of injection.

6. A method in accordance with claim 1, wherein the fuel and oxidant are at least partially premixed before injection into said combustion space.

7. A method in accordance with claim 1, wherein in a range of about 20% to about 200% of said combustion products are recirculated back into said root of said flame.

8. A method in accordance with claim 1, wherein at least one of said plates comprises at least one heat transfer enhancement feature.

9. A method in accordance with claim 8, wherein said at least one heat transfer enhancement feature is a plurality of dimples.

10. A method in accordance with claim 1, wherein the combustion products exiting the combustion space are passed through a heat exchanger for preheating at least one of said fuel and said oxidant.

11. A method in accordance with claim 1, wherein at least one of said fuel and said oxidant are segmented into individually controlled sections to provide temperature profiling across said surface.

12. An apparatus comprising:

two concentrically disposed cylindrical surfaces forming an annular space therebetween, one of said cylindrical surfaces forming at least one fuel inlet and at least one oxidant inlet oriented to introduce a fuel and an oxidant into said annular space and forming a combustion products outlet;

combustion means for burning said fuel whereby a sheet flame is produced in said annular space, said sheet flame conforming substantially to a curvature of said cylindrical surfaces; and recirculation means for recirculating combustion products produced by said sheet flame directly to a base region of said sheet flame.

13. An apparatus in accordance with claim 12, wherein at least one of said cylindrical surfaces is rotatable about a longitudinal axis.

14. An apparatus in accordance with claim 12, wherein an annular space facing surface of at least one of said cylindrical surfaces forms a plurality of depressions.

15. An apparatus in accordance with claim 13, wherein an annular space facing surface of at least one of said cylindrical surfaces forms a plurality of depressions.

16. An apparatus in accordance with claim 12 further comprising heat exchanger means adapted to transfer heat from combustion products produced by said sheet flame to at least one of said fuel and said oxidant.

17. An apparatus comprising:

two correspondingly shaped, spaced apart surfaces forming a combustion space therebetween;

a burner having a fuel outlet in fluid communication with said combustion space and adapted to generate a sheet flame within said combustion space; and recirculation means for recirculating at least a portion of combustion products from said sheet flame directly to a base region of said sheet flame.

18. An apparatus in accordance with claim 17, wherein said two correspondingly shaped, spaced apart surfaces are curved.

19. An apparatus in accordance with claim 17, wherein said two correspondingly shaped, spaced apart surfaces are concentrically disposed cylinders.

20. An apparatus in accordance with claim 17, wherein said burner is a premixed burner.

21. An apparatus in accordance with claim 17, wherein a space-facing side of at least one of said surfaces is dimpled.

22. An apparatus in accordance with claim 17, wherein said burner is a non-premixed burner.

* * * * *